US011098715B2

(12) United States Patent
Nakai et al.

(10) Patent No.: US 11,098,715 B2
(45) **Date of Patent: *Aug. 24, 2021**

(54) ASYMMETRICAL SCROLL COMPRESSOR

(71) Applicant: Panasonic Intellectual Property Management Co., Ltd., Osaka (JP)

(72) Inventors: Hiroaki Nakai, Shiga (JP); Atsushi Sakuda, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 212 days.

This patent is subject to a terminal disclaimer.

(21) Appl. No.: 16/463,261

(22) PCT Filed: Oct. 12, 2017

(86) PCT No.: PCT/JP2017/036936

§ 371 (c)(1),
(2) Date: May 22, 2019

(87) PCT Pub. No.: WO2018/096823

PCT Pub. Date: May 31, 2018

(65) Prior Publication Data

US 2020/0063737 A1 Feb. 27, 2020

(30) Foreign Application Priority Data

Nov. 24, 2016 (JP) ..... JP2016-228339

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0261* (2013.01); *F04C 23/008* (2013.01);
(Continued)

(58) Field of Classification Search
CPC ..... F04C 18/0215; F04C 18/0261; F04C 23/008; F04C 28/26; F04C 29/128; F04C 29/12; F04C 29/0007; F04C 2240/50
(Continued)

(56) References Cited

U.S. PATENT DOCUMENTS 5,855,475 A 1/1999 Fujio et al.
6,089,839 A * 7/2000 Bush ..... F04C 29/122 418/55.1
(Continued)

FOREIGN PATENT DOCUMENTS

CN 102245903 A 11/2011
JP 5-288166 11/1993
(Continued)

OTHER PUBLICATIONS

Machine Translation JP 4576081 (Year: 2021).*
(Continued)

*Primary Examiner* — Audrey B. Walter
*Assistant Examiner* — Dapinder Singh
(74) *Attorney, Agent, or Firm* — Hamre, Schumann, Mueller & Larson, P.C.

(57) ABSTRACT

In an asymmetrical scroll compressor, at least one injection port through which an intermediate-pressure refrigerant is injected into a first compression chamber and a second compression chamber, at least one injection port penetrating an end plate of a fixed scroll at a position where the injection port is open to the first compression chamber or the second compression chamber during a compression stroke after a suction refrigerant is introduced and closed. Further, the amount of a refrigerant injected from an injection port into the first compression chamber is made more than the amount of a refrigerant injected from the injection port into the second compression chamber.

9 Claims, 10 Drawing Sheets

(51) Int. Cl.
*F04C 28/26* (2006.01)
*F04C 29/12* (2006.01)

(52) U.S. Cl.
CPC ..... *F04C 28/26* (2013.01); *F04C 29/128* (2013.01); *F04C 2240/50* (2013.01)

(58) Field of Classification Search
USPC ..... 418/55.1, 55.2, 55.6
See application file for complete search history.

(56) References Cited

U.S. PATENT DOCUMENTS

| | | | | |
|---|---|---|---|---|
| 6,773,242 | B1 | 8/2004 | Perevozchikov | |
| 7,815,423 | B2 * | 10/2010 | Guo | F04C 29/042 418/55.1 |
| 8,025,492 | B2 * | 9/2011 | Seibel | F04C 23/008 418/55.4 |
| 8,506,271 | B2 * | 8/2013 | Seibel | F04C 23/008 418/55.4 |
| 2018/0245593 | A1 | 8/2018 | Nagahara | |

FOREIGN PATENT DOCUMENTS

| | | |
|---|---|---|
| JP | 9-170574 | 6/1997 |
| JP | 11-107945 | 4/1999 |
| JP | 2000-329082 | 11/2000 |
| JP | 2003-097460 | 4/2003 |
| JP | 4265128 | 5/2009 |
| JP | 4576081 | * 11/2010 |
| JP | 2016-164412 | 9/2016 |
| WO | 2010/070790 | 6/2010 |

OTHER PUBLICATIONS

The Extended European Search Report dated Nov. 14, 2019 for the related European Patent Application No. 17873954.6, 7 pages.
English Translation of Chinese Search Report dated Jan. 14, 2020 for the related Chinese Patent Application No. 201780071842.8.

* cited by examiner

ASYMMETRICAL SCROLL COMPRESSOR

This application is a U.S. national stage application of the PCT International Application No. PCT/JP2017/036936 filed on Oct. 12, 2017, which claims the benefit of foreign priority of Japanese patent application No. 2016-228339 filed on Nov. 24, 2016, the contents all of which are incorporated herein by reference.

TECHNICAL FIELD

The present invention relates to an asymmetrical scroll compressor particularly used for a refrigeration machine such as an air conditioner, a water heater, and a refrigerator.

BACKGROUND ART

In a refrigeration apparatus and an air conditioner, a compressor is used which sucks a gas refrigerant evaporated by an evaporator, compresses the gas refrigerant to a pressure required for condensation by a condenser, and sends high-temperature high-pressure gas refrigerant to a refrigerant circuit. Thus, an asymmetrical scroll compressor is provided with two expansion valves between the condenser and the evaporator and injects an intermediate-pressure refrigerant flowing between the two expansion valves to a compression chamber during a compression process, thereby aiming to reduce power consumption and improve capacity of a refrigeration cycle.

That is, the refrigerant circulating in the condenser is increased by the amount of the injected refrigerant. In the air conditioner, heating capacitor is improved. Further, since the injected refrigerant is in an intermediate pressure state, and power required for compression ranges from the intermediate pressure to the high pressure, a coefficient of performance (COP) can be improved and power consumption can be reduced, as compared to a case where the same function is provided without injection.

The amount of the refrigerant flowing in the condenser is equal to a sum of the amount of the refrigerant flowing in the evaporator and the amount of the injected refrigerant, and a ratio of the amount of the injected refrigerant to the amount of the refrigerant flowing in the condenser is an injection rate.

To increase an effect of injection, the injection rate may increase. Thus, the refrigerant is injected due to a pressure difference between the pressure of the injected refrigerant and the internal pressure of a compression chamber. To increase the injection rate, it is necessary to increase the pressure of the injected refrigerant.

However, when the pressure of the injected refrigerant increases, a liquid refrigerant is injected to the compression chamber, which causes a decrease in heating capacity and a decrease in reliability of the compressor.

In the refrigerant introduced into the compression chamber from an injection pipe, the gas refrigerant is preferentially extracted from a gas-liquid separator and is fed. However, when balance of intermediate pressure control is broken or when a transient condition is changed, in a state in which the liquid refrigerant is mixed with the gas refrigerant, the mixture is introduced from the injection pipe. In the compression chamber having many sliding parts, in order to keep a sliding state good, an appropriate amount of oil is fed and is compressed together with the refrigerant. However, when the liquid refrigerant is mixed, the oil in the compression chamber is washed by the liquid refrigerant. Thus, the sliding state deteriorates, components are worn or burned. Thus, it is important that the liquid refrigerant introduced from the injection pipe is not fed to the compression chamber as far as possible and only the gas refrigerant is guided to an injection port.

The intermediate pressure is controlled by adjusting an opening degree of the expansion valves respectively provided upstream or downstream of the gas-liquid separator, and an injection refrigerant is fed into the compression chamber by a pressure difference between the intermediate pressure and the internal pressure of the compression chamber in the compressor to which the injection pipe is finally connected. Therefore, when the intermediate pressure is adjusted high, the injection rate increases. Meanwhile, a gas-phase component ratio of the refrigerant introduced from the condenser via the expansion valves on the upstream side into the gas-liquid separator decreases as the intermediate pressure increases. Thus, when the intermediate pressure increases excessively, the liquid refrigerant of the gas-liquid separator increases and the liquid refrigerant flows to the injection pipe, which affects a decrease in heating capacity and reliability of the compressor. Thus, a configuration which obtains a large amount of the injected refrigerant using the intermediate pressure as low as possible is desirable as the compressor, and a scroll type having a slow compression speed is suitable as a compression method.

By the way, a configuration in which one injection port is sequentially open to both the compression chambers, particularly, more injected refrigerant is fed to the second compression chamber (for example, see PTL 1) is disclosed as an asymmetrical scroll compressor in which a large volume compression chamber (hereinafter, referred to as a first compression chamber) is defined outside an orbiting scroll wrap and a small volume compression chamber (hereinafter, referred to as a second compression chamber) is defined inside the orbiting scroll wrap. Accordingly, as a deviation between pressing forces of a fixed scroll and an orbiting scroll due to the asymmetry of the scroll compressor is alleviated, the injected refrigerant is sent to the first compression chamber while behavior of the orbiting scroll is stabilized, so that the injection rate is improved.

CITATION LIST

Patent Literature

PTL 1: Japanese Patent No. 4265128

SUMMARY OF THE INVENTION

An opening section of an injection port to two compression chambers is largely related to the amount of a refrigerant injected into the compression chambers.

In PTL 1, when the amount of the refrigerant injected into a first compression chamber is more than the amount of the refrigerant injected into a second compression chamber, a gap or a frictional force is increased due to a change in an unbalanced amount of a pressing force, thereby causing a reduction in efficiency.

However, in PTL 1, it is considered that an original effect of an injection cycle could not be realized due to two problems.

A first problem is that, as described in Table 1 (not shown) of PTL 1, since the injection port is open before the suction refrigerant is introduced and closed in the first compression chamber, the injection refrigerant flows back to a suction side. As pointed out by PTL 1 itself, this point leads to a conclusion that when the injection port is open during a suction process, even though an injection effect cannot be expected, through comparison between a specification for injection during the suction process and a specification for injection after the compression chamber is closed, the large amount of the injected refrigerant should be injected into the second compression chamber. Therefore, this is not suitable as a comparison of optimum injections.

Further, a second problem is that an injection pipe connected to the compressor is provided with a check valve. Since the injection pipe is provided with a check valve, loss due to an invalid volume in a compression chamber opening section occurs in a passage to the injection port and the injection pipe. It is considered that when the opening section is set wide, the loss occurs more.

Further, an internal pressure increasing rate of the second compression chamber having a small volume is faster than that of the first compression chamber because of a small suction volume. In order to increase the amount of the injection into the second compression chamber, it is necessary to limit the injection into the first compression chamber, which is a factor in lowering the injection rate.

The present invention relates to an asymmetrical scroll compressor which can cope with even operation at a higher injection rate to maximize an original effect of the injection cycle, and can enlarge a capacity improvement amount.

The asymmetrical scroll compressor according to the present invention comprises a fixed scroll including a first spiral wrap standing up from an end plate of the fixed scroll, and an orbiting scroll including a second spiral wrap standing up from an end plate of the orbiting scroll, in which a first spiral wrap of the fixed scroll and a second spiral wrap of the orbiting scroll are engaged with each other to define a compression chamber between the fixed scroll and the orbiting scroll. Further, the compression chamber includes a first compression chamber on an outer wrap wall side of the orbiting scroll and a second compression chamber on an inner wrap wall side of the orbiting scroll. Further, in the asymmetrical scroll compressor in which a suction volume of the first compression chamber is more than a suction volume of the second compression chamber, at least one injection port through which the intermediate-pressure refrigerant is injected into the first compression chamber and the second compression chamber, the at least one injection port penetrating the end plate of the fixed scroll at a position where the injection port is open to the first compression chamber or the second compression chamber during a compression stroke after a suction refrigerant is introduced and closed. Further, the amount of the refrigerant injected from the injection port into the first compression chamber is more than the amount of the refrigerant injected from the injection port into the second compression chamber.

In this way, as the refrigerant is injected into the first compression chamber having a large volume, an injection rate increases, so that an injection cycle effect can be maximized, efficiency can be improved more than ever, and a capacity expansion effect can be obtained.

DESCRIPTION OF EMBODIMENTS

First Embodiment

Hereinafter, an asymmetrical scroll compressor according to a first embodiment of the present invention will be described. The present invention is not limited to the following embodiments.

Figure 1:
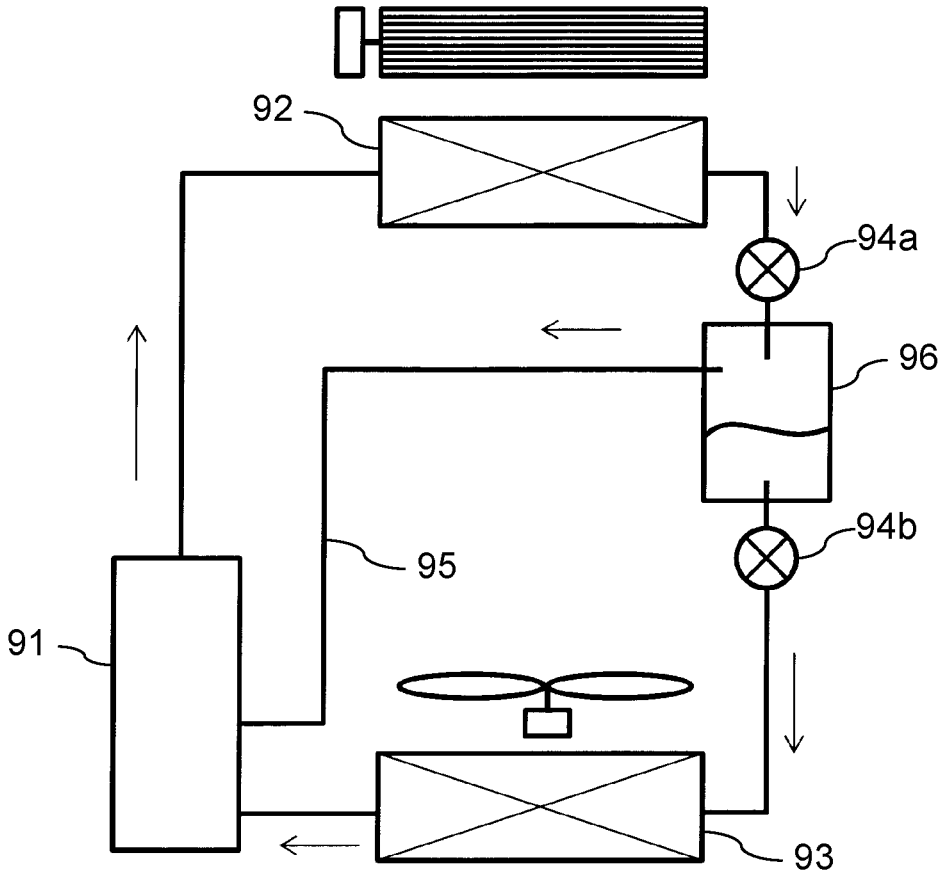
FIG. 1 is a diagram showing a refrigeration cycle including an asymmetrical scroll compressor according to a first embodiment of the present invention.

FIG. 1 is a diagram showing a refrigeration cycle including the asymmetrical scroll compressor according to the first embodiment.

As illustrated in FIG. 1, a refrigeration cycle device including the asymmetrical scroll compressor according to the present embodiment includes compressor 91, condenser 92, evaporator 93, expansion valves 94*a* and 94*b*, injection pipe 95, and gas-liquid separator 96 as components.

A refrigerant, which is a working fluid condensed by condenser 92, is depressurized to an intermediate pressure by expansion valve 94*a* on an upstream side, and gas-liquid separator 96 separates the refrigerant at the intermediate pressure into a gas-phase component (a gas refrigerant) and a liquid-phase component (a liquid refrigerant). The liquid refrigerant depressurized to the intermediate pressure further passes through expansion valve 94*b* on the downstream side, becomes a low-pressure refrigerant, and is guided to evaporator 93.

The liquid refrigerant sent to evaporator 93 is evaporated by heat exchange and is discharged as the gas refrigerant or the gas refrigerant partially mixed with the liquid refrigerant. The refrigerant discharged from evaporator 93 is incorporated in the compression chamber of compressor 91.

Meanwhile, the gas refrigerant separated by gas-liquid separator 96 and being at an intermediate pressure passes through injection pipe 95 and is guided to the compression chamber in compressor 91. A closure valve or an expansion valve is provided in injection pipe 95 and is suitable for a mechanism that adjusts and stops the injection pressure.

Compressor 91 compresses a low-pressure refrigerant flowing from evaporator 93, injects the refrigerant in gas-liquid separator 96 at an intermediate pressure to the compression chamber in a compression process to compress the refrigerant, and sends the high-temperature high-pressure refrigerant from a discharge tube to condenser 92.

In a ratio of the liquid-phase component to the gas-phase component separated by gas-liquid separator 96, as a pressure difference between an inlet-side pressure and an outlet-side pressure of expansion valve 94*a* provided on the upstream side increases, the amount of the gas-phase component increases. Further, as a supercooling degree of the refrigerant at an outlet of condenser 92 decreases or a depletion degree thereof increases, the amount of the gas-phase component increases.

Meanwhile, the amount of the refrigerant sucked through injection pipe 95 by compressor 91 increases as the intermediate pressure increases. Thus, when the refrigerant of which the ratio of the gas-phase component is more than the ratio of the gas-phase component of the refrigerant separated by gas-liquid separator 96 is sucked from injection pipe 95, the gas refrigerant in gas-liquid separator 96 is depleted, and the liquid refrigerant flows to injection pipe 95. It is preferable that in order to maximize capacity of compressor 91, the gas refrigerant separated by gas-liquid separator 96 is sucked from injection pipe 95 to compressor 91. However, when the refrigerant escapes from this balanced state, the liquid refrigerant flows from injection pipe 95 to compressor 91. Thus, even in this case, it is necessary that compressor 91 is configured to maintain high reliability.

Figure 2:
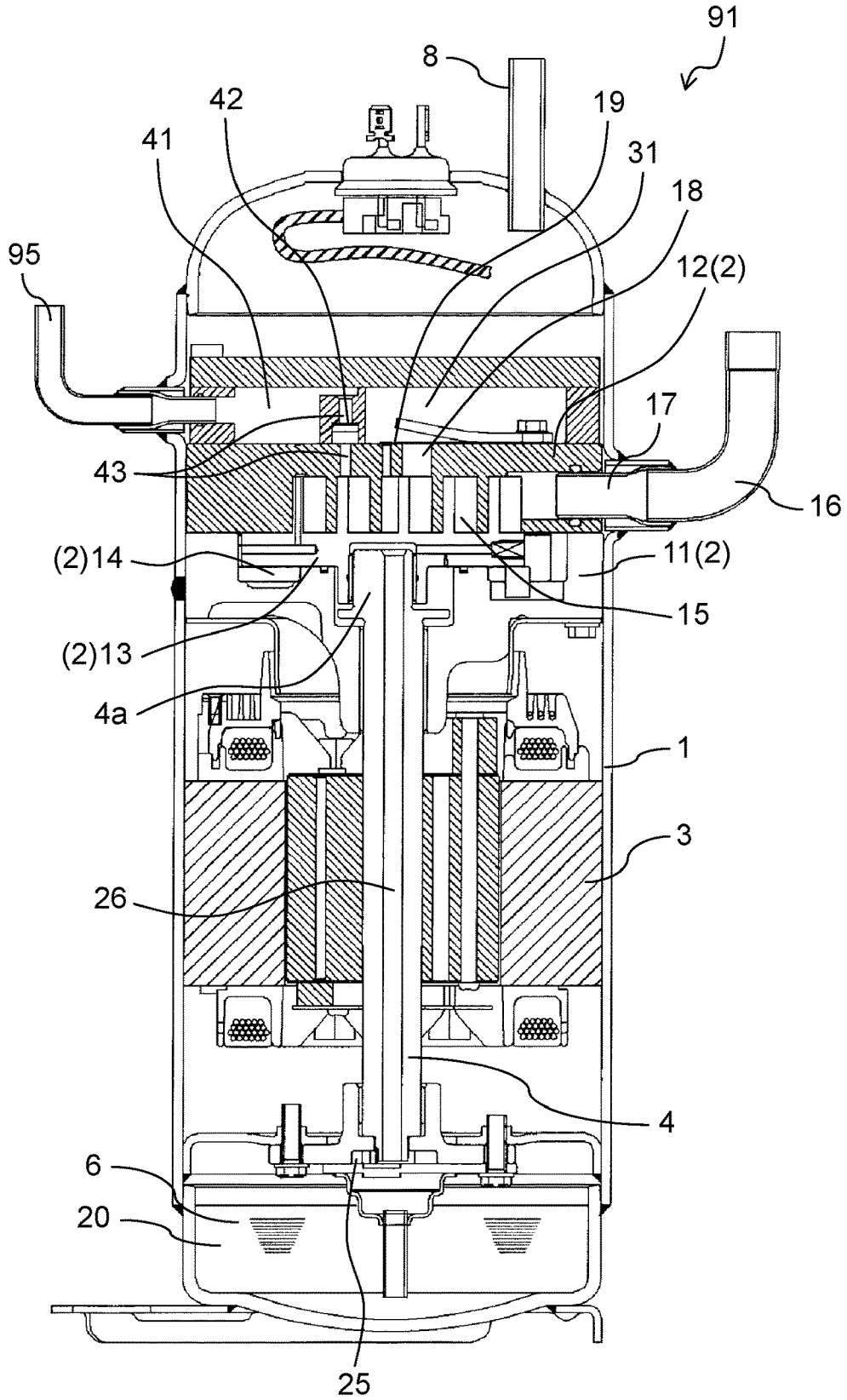
FIG. 2 is a longitudinal sectional view showing the asymmetrical scroll compressor according to the first embodiment of the present invention.
Figure 3:
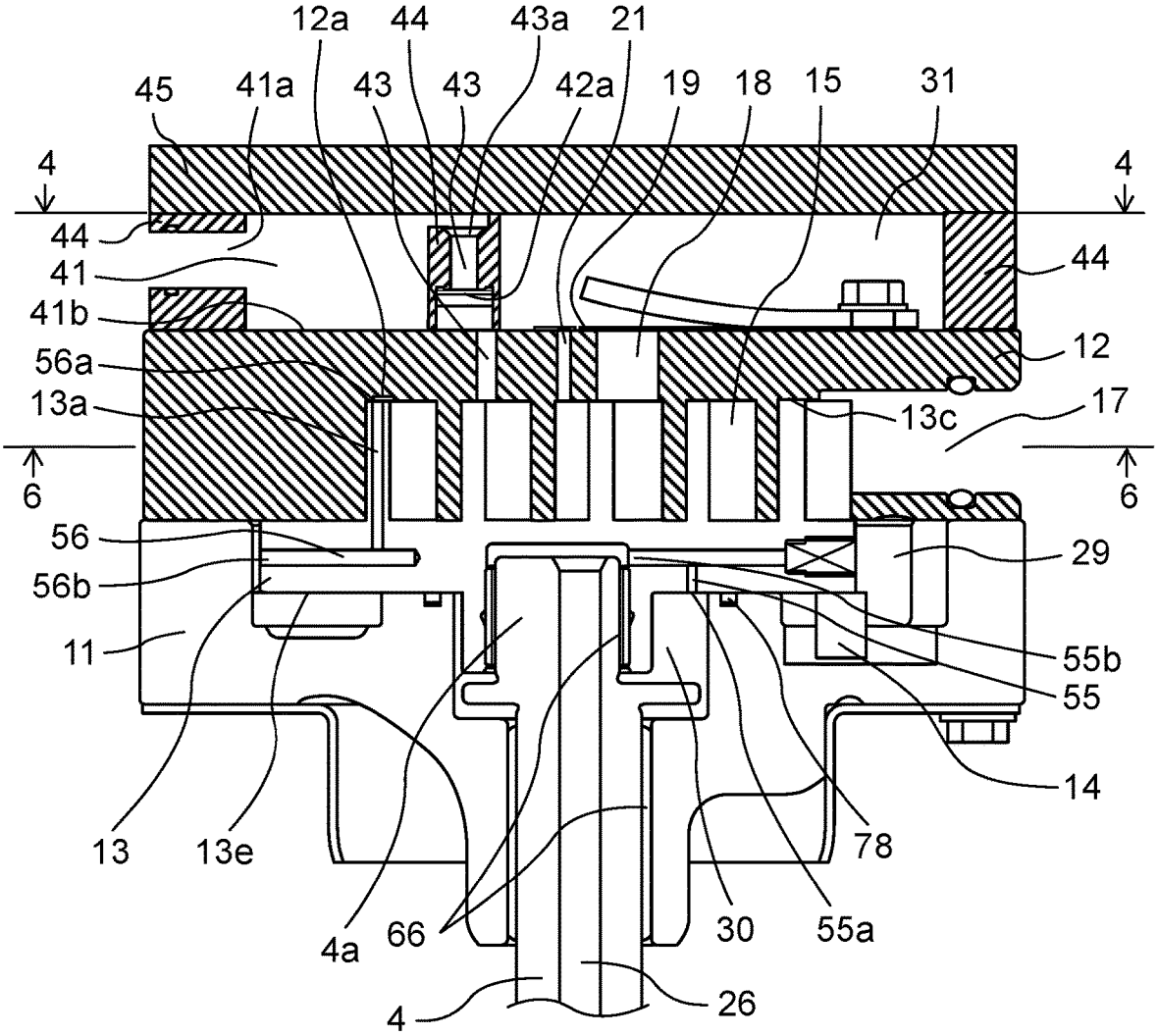
FIG. 3 is an enlarged view showing a main part of FIG. 2.
Figure 4:
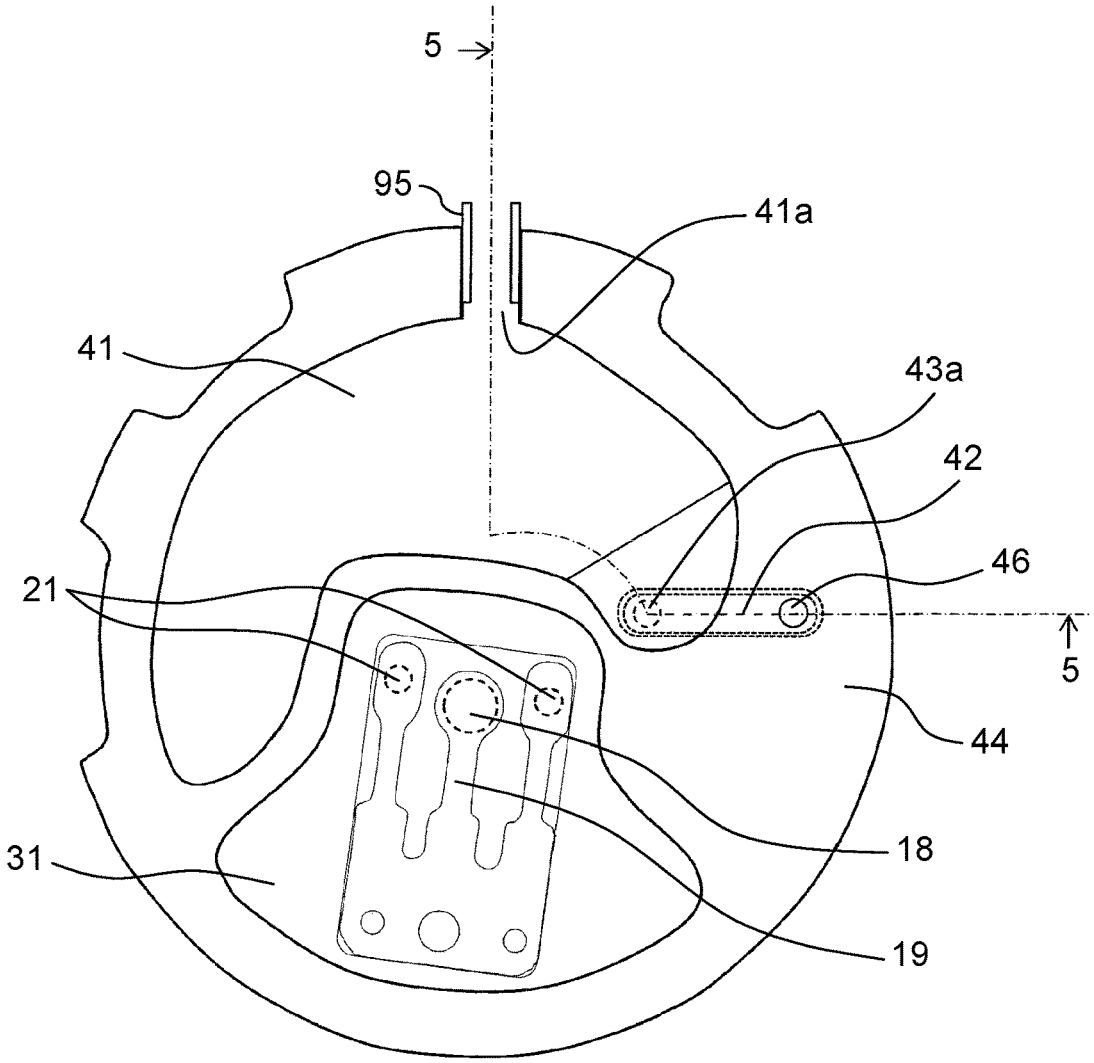
FIG. 4 is a view taken along line 4-4 of FIG. 3.
Figure 5:
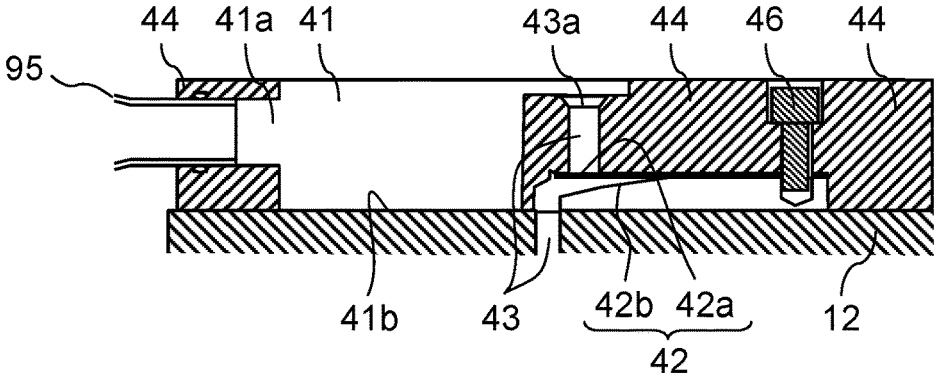
FIG. 5 is a view taken along line 5-5 of FIG. 4.

FIG. 2 is a longitudinal sectional view showing the asymmetrical scroll compressor according to the present embodiment. FIG. 3 is an enlarged view showing a main part of FIG. 2. FIG. 4 is a view taken along line 4-4 of FIG. 3. FIG. 5 is a view taken along line 5-5 of FIG. 4.

As illustrated in FIG. 2, compressor 91 includes compression mechanism 2, motor unit 3, and oil reservoir 20 inside sealed container 1.

Compression mechanism 2 includes main bearing member 11 fixed to sealed container 1 through welding or shrink fitting, fixed scroll (a compression chamber partitioning member) 12 fixed to main bearing member 11 through a bolt, and orbiting scroll 13 engaged with fixed scroll 12. Shaft 4 is pivotally supported by main bearing member 11.

Rotation restraining mechanism 14 such as an Oldham ring, which prevents rotation of orbiting scroll 13 and guides orbiting scroll 13 to perform a circular orbiting movement, is provided between orbiting scroll 13 and main bearing member 11.

Orbiting scroll 13 is eccentrically driven by eccentric shaft portion 4*a* at an upper end of shaft 4 and circularly orbits by rotation restraining mechanism 14.

Compression chamber 15 is defined between fixed scroll 12 and orbiting scroll 13.

Suction pipe 16 penetrates sealed container 1 to the outside, and suction port 17 is provided at an outer circumferential portion of fixed scroll 12. The working fluid (the refrigerant) sucked from suction pipe 16 is guided from suction port 17 to compression chamber 15. Compression chamber 15 moves from an outer circumferential side to a central portion while the volume thereof is reduced. The working fluid that reaches a predetermined pressure in compression chamber 15 is discharged from discharge port 18 provided at a central portion of fixed scroll 12 to discharge chamber 31. Discharge reed valve 19 is provided in the discharge port 18. The working fluid that reaches the predetermined pressure in compression chamber 15 pushes and opens discharge reed valve 19 to be discharged to discharge chamber 31. The working fluid discharged to discharge chamber 31 is discharged to the outside of sealed container 1.

Meanwhile, the working fluid at the intermediate pressure, guided from injection pipe 95, flows to intermediate pressure chamber 41, opens check valve 42 provided in injection port 43, is injected into compression chamber 15 after the working fluid is enclosed, and is discharged from discharge port 18 into sealed container 1 together with the working fluid sucked from suction port 17.

Pump 25 is provided at a lower end of shaft 4. Pump 25 is disposed such that a suction port thereof exists in oil reservoir 20. Pump 25 is driven by shaft 4 and can certainly pump up oil 6 in oil reservoir 20 provided at a bottom portion of sealed container 1 regardless of a pressure condition and an operation speed. Thus, a concern about shortage of oil 6 is alleviated. Oil 6 pumped up by pump 25 is supplied to compression mechanism 2 through oil supplying hole 26 defined in shaft 4. Before and after oil 6 is pumped up by pump 25, when foreign substances are removed from oil 6 by an oil filter or the like, the foreign substances can be prevented from being introduced into compression mechanism 2, and reliability can be further improved.

The pressure of oil 6 guided to compression mechanism 2 is substantially the same as a discharge pressure of the scroll compressor and serves as a back pressure source for orbiting scroll 13. Accordingly, orbiting scroll 13 stably exhibits a predetermined compression function without being separated from or colliding with fixed scroll 12.

As illustrated in FIG. 3, sealing member 78 is disposed on rear surface 13*e* of an end plate of orbiting scroll 13.

High-pressure area 30 is defined inside sealing member 78, and back-pressure chamber 29 is defined outside sealing member 78. Back-pressure chamber 29 is set to a pressure between a high pressure and a low pressure. Since high-pressure area 30 and back-pressure chamber 29 can be separated from each other using sealing member 78, application of the pressure from rear surface 13*e* of orbiting scroll 13 can be stably controlled.

Connection passage 55 from high-pressure area 30 to back-pressure chamber 29 and supply passage 56 from back-pressure chamber 29 to second compression chamber 15*b* (see FIG. 6) are provided as an oil supplying passage from oil reservoir 20. As connection passage 55 from high-pressure area 30 to back-pressure chamber 29 is provided, oil 6 can be supplied to a sliding portion of rotation restraining mechanism 14 and a thrust sliding portion of fixed scroll 12 and orbiting scroll 13.

First opening end 55*a* of connection passage 55 is defined on rear surface 13*e* of orbiting scroll 13 and travels between the inside and the outside of sealing member 78, and second opening end 55*b* is always open to high-pressure area 30. Accordingly, intermittent oil supplying can be realized.

A part of oil 6 enters a fitting portion between eccentric shaft portion 4*a* and orbiting scroll 13 and bearing portion 66 between shaft 4 and main bearing member 11 so as to obtain an escape area by supply pressure or self weight, falls after lubricating each component, and returns to oil reservoir 20.

In the asymmetrical scroll compressor according to the present embodiment, the oil supplying passage to compression chamber 15 is configured with passage 13*a* defined inside orbiting scroll 13 and recess 12*a* defined in a wrap side end plate of fixed scroll 12. Third opening end 56*a* of passage 13*a* is defined at wrap tip end 13*c* and is periodically opened to recess 12*a* according to the orbiting movement. Further, fourth opening end 56*b* of passage 13*a* is always open to back-pressure chamber 29. Accordingly, back-pressure chamber 29 and second compression chamber 15*b* can intermittently communicate with each other.

Injection port 43 for injecting the refrigerant at the intermediate pressure is provided to penetrate the end plate of fixed scroll 12. Injection port 43 is sequentially open to first compression chamber 15*a* (see FIG. 6) and second compression chamber 15*b*. Injection port 43 is provided at a position where injection port 43 is open during a compression process after the refrigerant is introduced into and closed in first compression chamber 15*a* and second compression chamber 15*b*.

Discharge bypass port 21 through which the refrigerant compressed in compression chamber 15 is discharged before discharge bypass port 21 communicates with discharge port 18 is provided in the end plate of fixed scroll 12.

As illustrated in FIGS. 3 and 4, compressor 91 according to the present embodiment is provided with intermediate pressure chamber 41 that guides an intermediate pressure working fluid fed from injection pipe 95 and before being injected into compression chamber 15.

Intermediate pressure chamber 41 is defined with fixed scroll 12 that is a compression chamber partitioning member, intermediate pressure plate 44, and intermediate pressure cover 45. Intermediate pressure chamber 41 and compression chamber 15 face each other with fixed scroll 12 interposed therebetween. Intermediate pressure chamber 41 has intermediate pressure chamber inlet 41*a* into which the intermediate pressure working fluid flows and liquid reservoir portion 41*b* defined at a position lower than intermediate pressure chamber inlet 41*a* and injection port inlet 43*a* of injection port 43 through which the intermediate pressure working fluid is injected into compression chamber 15.

Liquid reservoir portion 41*b* is defined on an upper surface of the end plate of fixed scroll 12.

Intermediate pressure plate 44 is provided with check valve 42 that prevents backflow of the refrigerant from compression chamber 15 to intermediate pressure chamber 41. In a section in which injection port 43 is open to compression chamber 15, when the internal pressure of compression chamber 15 is higher than the intermediate pressure of injection port 43, the refrigerant flows backward from compression chamber 15 to intermediate pressure chamber 41. Thus, check valve 42 is provided to prevent the backflow of the refrigerant.

In compressor 91 according to the present embodiment, check valve 42 is configured with reed valve 42*a* lifted to compression chamber 15 side and causing compression chamber 15 and intermediate pressure chamber 41 to communicate with each other. Check valve 42 causes compression chamber 15 and intermediate pressure chamber 41 to communicate with each other only when the internal pressure of compression chamber 15 is lower than the pressure of intermediate pressure chamber 41. By using reed valve 42*a*, the number of sliding portions in a movable portion becomes small, sealing performance can be maintained for a long time, and a flow passage area can be easily enlarged as needed.

When check valve 42 is not provided or check valve 42 is provided in injection pipe 95, the refrigerant in compression chamber 15 flows backward to injection pipe 95, and unnecessary compression power is consumed. Check valve 42 according to the present embodiment is provided in intermediate pressure plate 44 close to compression chamber 15 to suppress the backflow from compression chamber 15.

The upper surface of the end plate of fixed scroll 12 is located closer to intermediate pressure chamber inlet 41*a*, and the upper surface of the end plate of fixed scroll 12 is provided with liquid reservoir portion 41*b* in which the working fluid in a liquid-phase component is collected. Further, injection port inlet 43*a* is provided at a position higher than the height of intermediate pressure chamber inlet 41*a*. Thus, among the intermediate pressure working fluid, the working fluid in a gas-phase component is guided to injection port 43. Since the working fluid in the liquid-phase component collected in liquid reservoir portion 41*b* is evaporated in the surface of fixed scroll 12 in a high-temperature state, it is difficult for the working fluid in the liquid-phase component to flow into compression chamber 15.

Further, intermediate pressure chamber 41 and discharge chamber 31 are provided adjacent to each other through intermediate pressure plate 44. It is possible to suppress an increase in the temperature of the high-pressure refrigerant of discharge chamber 31 while evaporation when the working fluid in the liquid-phase component flows into intermediate pressure chamber 41 is promoted. Thus, operation can be performed even in a high discharge pressure condition by that degree.

The intermediate pressure working fluid guided to injection port 43 pushes and opens reed valve 42*a* by a pressure difference between injection port 43 and compression chamber 15 and is joined to a low pressure working fluid sucked by suction port 17 in compression chamber 15. However, the intermediate pressure working fluid remaining in injection port 43 between check valve 42 and compression chamber 15 is repeatedly expanded and compressed again, which causes a decrease in efficiency of compressor 91. Thus, the thickness of valve stop 42*b* (see FIG. 5) for regulating a maximum displacement of reed valve 42*a* is changed according to the lift regulation point of reed valve 42*a*, and the volume of injection port 43 downstream of reed valve 42*a* is configured to be small.

Further, reed valve 42*a* and valve stop 42*b* are fixed to intermediate pressure plate 44 through fixing member 46 having a bolt. A fixing hole of fixing member 46 provided in valve stop 42*b* is opened only to the insertion side of fixing member 46 without penetrating valve stop 42*b*. As a result, fixing member 46 is configured to be open only in intermediate pressure chamber 41. Accordingly, leakage of the working fluid between intermediate pressure chamber 41 and compression chamber 15 through a gap of fixing member 46 can be suppressed, so that the injection rate can be improved.

Intermediate pressure chamber 41 has a suction volume that is equal to or more than a suction volume of compression chamber 15 to be able to perform sufficient supplying to compression chamber 15 by an injection amount. Herein, the suction volume is the volume of compression chamber 15 at a time point when the working fluid guided from suction port 17 is introduced into and closed in compression chamber 15, that is, at a time point when a suction process is completed, and is the total volume of first compression chamber 15*a* and second compression chamber 15*b*. In compressor 91 according to the present embodiment, intermediate pressure chamber 41 is provided to be spread on a flat surface of the end plate of fixed scroll 12 so as to expand the volume thereof. However, when a part of oil 6 enclosed in compressor 91 goes out from compressor 91 together with a discharge refrigerant, and returns to intermediate pressure chamber 41 through injection pipe 95 from gas-liquid separator 96, if the amount of oil 6 remaining in liquid reservoir portion 41*b* is too large, oil 6 in oil reservoir 20 runs short. Thus, it is not appropriate that the volume of intermediate pressure chamber 41 is too large. Because of this, it is preferable that the volume of intermediate pressure chamber 41 is equal to or more than the suction volume of compression chamber 15, and is equal to or less than a half of the oil volume of enclosed oil 6.

Figure 6:
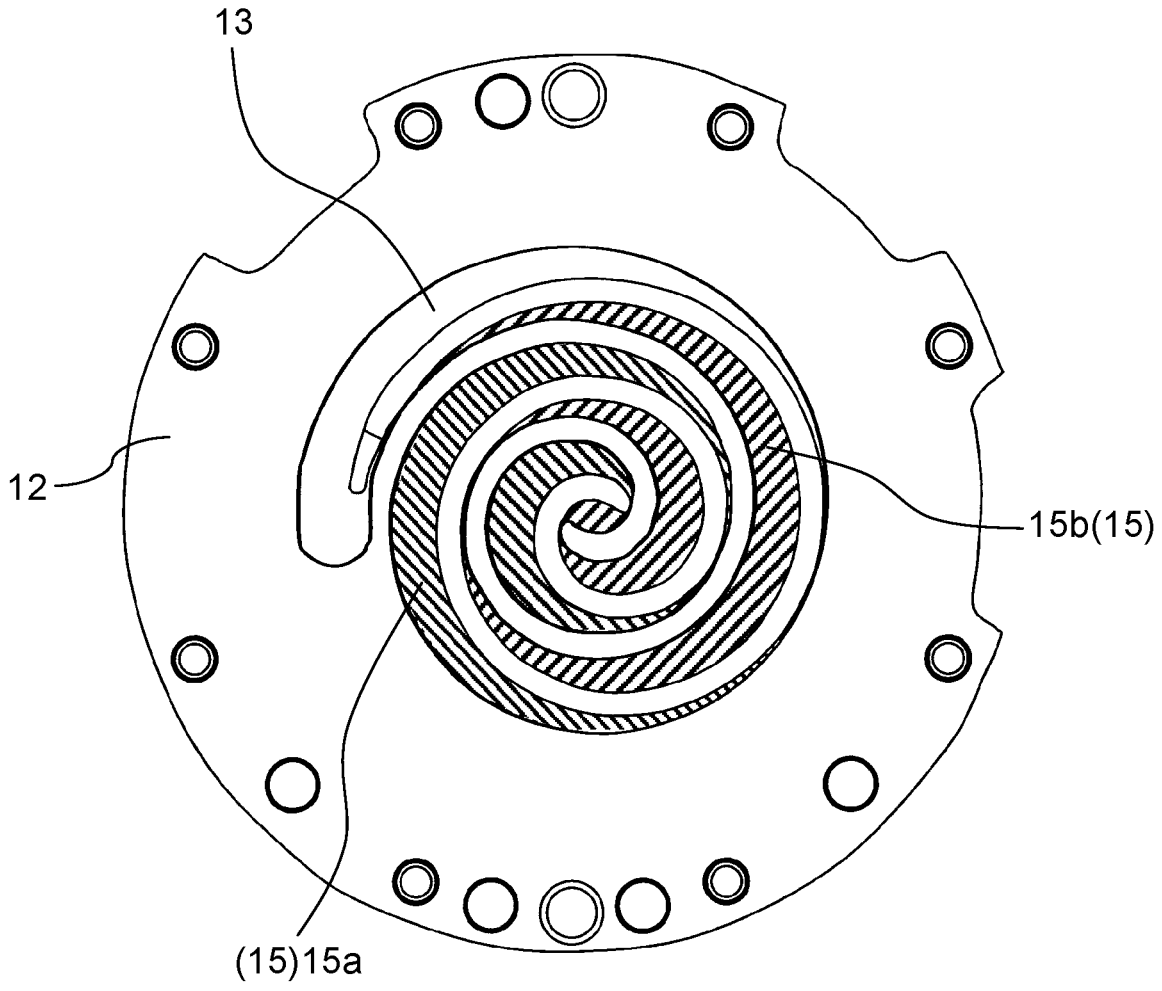
FIG. 6 is a view taken along line 6-6 of FIG. 3.

FIG. 6 is a view taken along line 6-6 of FIG. 3.

FIG. 6 is a view showing a state in which orbiting scroll 13 is engaged with fixed scroll 12 when viewed from rear surface 13*e* (see FIG. 3) side of orbiting scroll 13. As illustrated in FIG. 6, in a state in which fixed scroll 12 and orbiting scroll 13 are engaged with each other, a spiral wrap of fixed scroll 12 extends to be equivalent to a spiral wrap of orbiting scroll 13.

Compression chamber 15 defined with fixed scroll 12 and orbiting scroll 13 includes first compression chamber 15*a* defined on an outer wrap wall side of orbiting scroll 13 and second compression chamber 15*b* defined on an inner wrap wall side of orbiting scroll 13.

A spiral wrap is configured such that a position where the working fluid of first compression chamber 15*a* is confined and a position where the working fluid of second compression chamber 15*b* is confined are shifted by about 180 degrees.

At a timing when the working fluid is confined, first compression chamber 15*a* and second compression chamber 15*b* are shifted by about 180 degrees. After first compression chamber 15*a* is closed, shaft 4 is rotated by 180 degrees, so that second compression chamber 15*b* is closed. Accordingly, in first compression chamber 15*a*, influence on suction heating can be reduced, and the suction volume can be maximized. That is, since the wrap height can be set low, and as a result, leakage clearance (=a leakage cross-sectional area) of the radial contact point portion of the wrap can be reduced, leakage loss can be further reduced.

Figure 7:
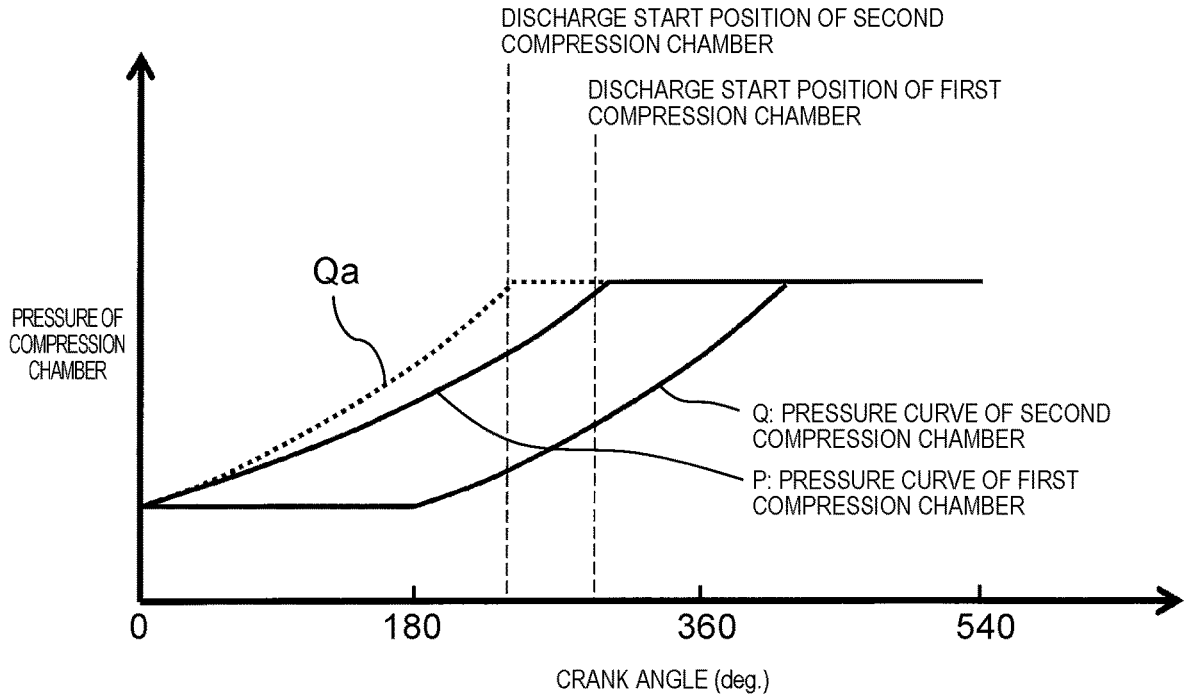
FIG. 7 is a diagram showing a relationship of an internal pressure and a discharge start position of the compression chamber of the asymmetrical scroll compressor when an injection operation is not accompanied.

FIG. 7 is a diagram showing a relationship of an internal pressure and a discharge start position of the compression chamber of the asymmetrical scroll compressor when an injection operation is not accompanied.

Pressure curve P showing a pressure change of first compression chamber 15*a* with respect to a crank angle that is a rotation angle of a crank, pressure curve Q showing a pressure change of second compression chamber 15*b*, and pressure curve Qa of which a compression start point is matched with a compression start point of pressure curve P by sliding pressure curve Q by 180 degrees is shown in FIG. 7. The suction volume of first compression chamber 15*a* is more than the suction volume of second compression chamber 15*b*. Because of this, when the injection operation is not performed, as can be seen from comparison between pressure curve P and pressure curve Qa of FIG. 7, a pressure increasing rate of second compression chamber 15*b* is faster than a pressure increasing rate of first compression chamber 15*a*.

In terms of a rotation angle of shaft 4 from a compression start position, second compression chamber 15*b* early reaches the discharge pressure. A volume ratio is defined by a ratio of the suction volume of compression chamber 15 to the discharge volume of compression chamber 15 at which the refrigerant can be discharged as compression chamber 15 communicates with discharge port 18 (see FIG. 3) and discharge bypass port 21 (see FIG. 3). A volume ratio of second compression chamber 15*b* having a small suction volume is equal to or less than first compression chamber 15*a*. However, in the scroll compressor according to the present embodiment, since first compression chamber 15*a* early reaches the discharge pressure due to an effect of the injection refrigerant, which will be described below, the volume ratio of first compression chamber 15*a* is less than the volume ratio of second compression chamber 15*b*. Accordingly, a problem is solved in which in spite of the fact that compression chamber 15 is compressed such that the internal pressure is equal to or more than the discharge pressure, since compression chamber 15 does not communicate with discharge port 18 or discharge bypass port 21, compression chamber 15 is compressed to the discharge pressure or more.

Further, a slope shape is provided at wrap tip end 13*c* (see FIG. 3) of orbiting scroll 13 from a winding start portion that is a central portion to a winding end portion that is an outer circumferential portion based on a result obtained by measuring a temperature distribution during operation such that a wing height gradually increases. Accordingly, a dimensional change due to heat expansion is absorbed, and local sliding is easily prevented.

Figure 8:
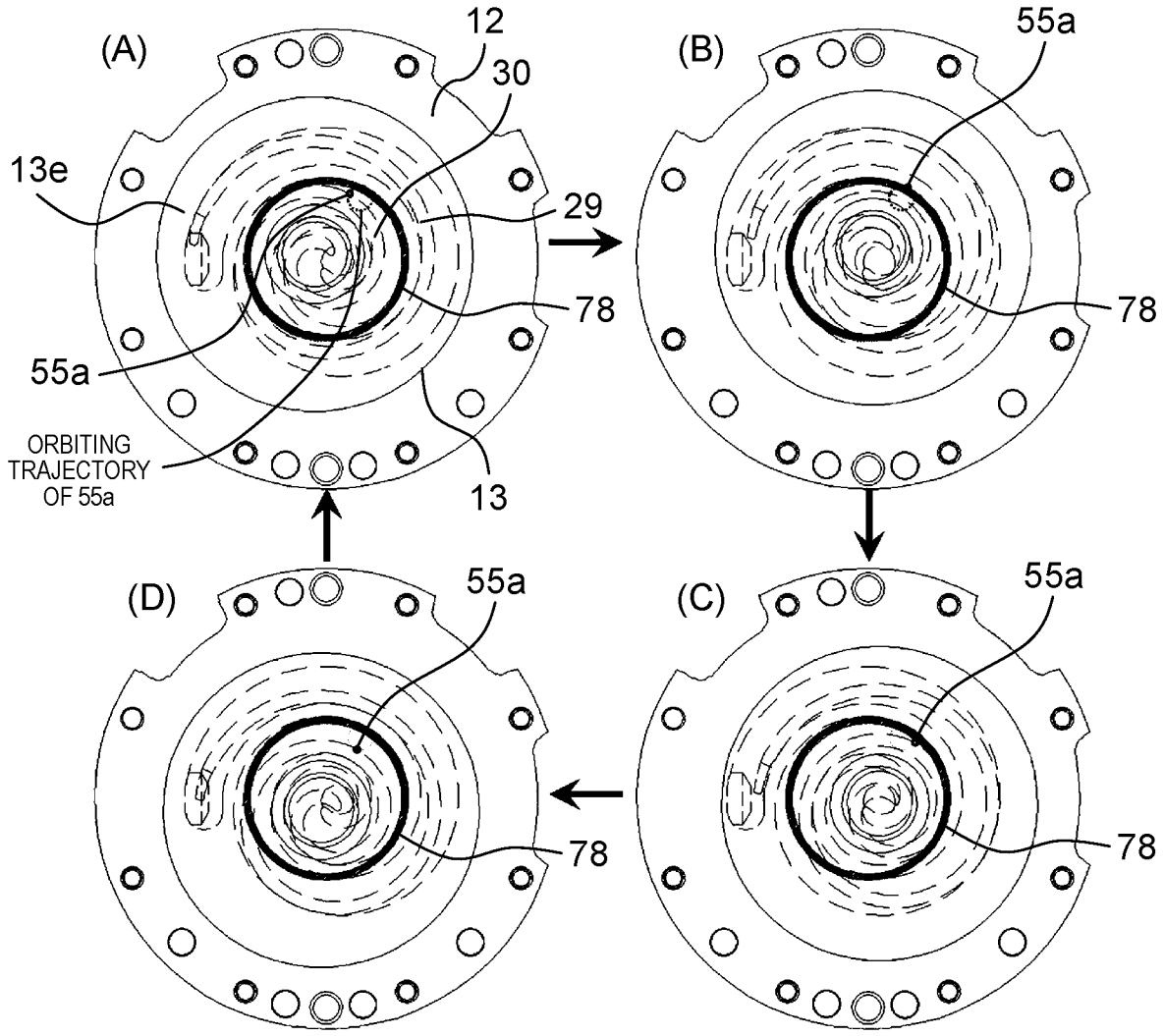
FIG. 8 is a diagram for illustrating a positional relationship between an oil supplying passage and a sealing member accompanying an orbiting movement of the asymmetrical scroll compressor according to the first embodiment of the present invention.

FIG. 8 is a diagram for illustrating a positional relationship between an oil supplying passage and a sealing member accompanying an orbiting movement of the asymmetrical scroll compressor according to the present embodiment.

FIG. 8 is a view illustrating a state in which orbiting scroll 13 is engaged with fixed scroll 12 when viewed from rear surface 13*e* side of orbiting scroll 13, in which the phases of orbiting scroll 13 are sequentially shifted by 90 degrees.

First opening end 55*a* of connection passage 55 is defined on rear surface 13*e* of orbiting scroll 13.

As illustrated in FIG. 8, rear surface 13*e* of orbiting scroll 13 is partitioned into high-pressure area 30 on an inner side and back-pressure chamber 29 on an outer side by sealing member 78.

In a state of FIG. 8(B), since first opening end 55*a* is open to back-pressure chamber 29 that is an outer side of sealing member 78, oil 6 is supplied.

In contrast, in FIGS. 8(A), 8(C), and 8(D), since first opening end 55*a* is open to an inside of sealing member 78, the oil is not supplied.

That is, although first opening end 55*a* of connection passage 55 travels between high-pressure area 30 and back-pressure chamber 29, oil 6 is supplied to back-pressure chamber 29 only when a pressure difference occurs between first opening end 55*a* and second opening end 55*b* (see FIG. 3) of connection passage 55. With this configuration, since the amount of the supplied oil can be adjusted at a rate of time when first opening end 55*a* travels sealing member 78, the passage diameter of connection passage 55 (see FIG. 3) can be configured to be 10 times or more the size of the oil filter. Accordingly, since there is no risk that foreign substances are caught by passage 13*a* (see FIG. 3) and passage 13*a* is blocked, the scroll compressor can be provided in which the back pressure can be stably applied and lubrication of the thrust sliding portion, rotation restraining mechanism 14 (see FIG. 3) can be maintained in a good state, and high efficiency and high reliability can be realized. In the present embodiment, a case where second opening end 55*b* is always located in high-pressure area 30 and first opening end 55*a* travels between high-pressure area 30 and back-pressure chamber 29 has been described as an example. However, even when second opening end 55*b* travels between high-pressure area 30 and back-pressure chamber 29, and first opening end 55*a* is always located in back-pressure chamber 29, a pressure difference occurs between first opening end 55*a* and second opening end 55*b*. Thus, intermittent oil supplying can be realized and similar effects can be obtained.

Figure 9:
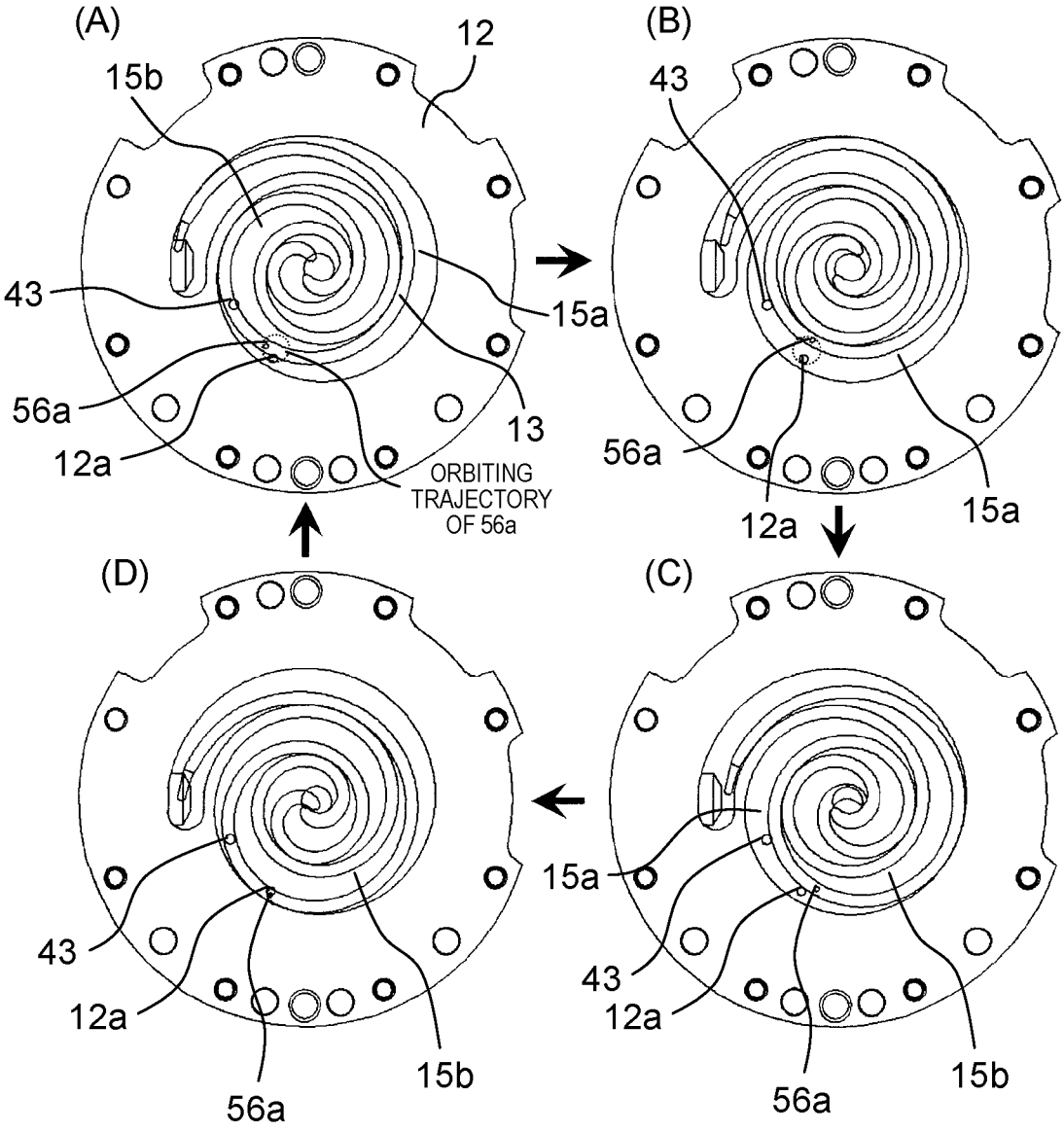
FIG. 9 is a diagram for illustrating an opening state of the oil supplying passage and an injection port accompanying the orbiting movement of the asymmetrical scroll compressor according to the first embodiment of the present invention.

FIG. 9 is a diagram for illustrating an opening state of the oil supplying passage and an injection port accompanying the orbiting movement of the asymmetrical scroll compressor according to the present embodiment.

FIG. 9 shows a state in which orbiting scroll 13 is engaged with fixed scroll 12, in which the phases of fixed scroll 12 are sequentially shifted by 90 degrees.

As illustrated in FIG. 9, intermittent communication is realized by periodically opening third opening end 56*a* of passage 13*a* defined in wrap tip end 13*c* (see FIG. 3) to recess 12*a* defined in the end plate of fixed scroll 12.

In a state of FIG. 9(D), third opening end 56*a* is open to recess 12*a*. In this state, oil 6 is supplied from back-pressure chamber 29 (see FIG. 3) to second compression chamber 15*b* through supply passage 56 (see FIG. 3) or passage 13*a*. In this way, the oil supplying passage by third opening end 56*a* is provided at a position that is open to second compression chamber 15*b* during a compression stroke after the suction refrigerant is introduced and closed.

In contrast, in FIGS. 9(A), 9(B), and 9(C), since third opening end 56*a* is not open to recess 12*a*, oil 6 is not supplied from back-pressure chamber 29 to second compression chamber 15*b*. Hereinabove, since oil 6 in back-pressure chamber 29 is intermittently guided to second compression chamber 15*b* through the oil supplying passage, a fluctuation in the pressure of back-pressure chamber 29 can be suppressed, and control can be performed to a predetermined pressure. Further, similarly, oil 6 supplied to second compression chamber 15*b* serves to improve the sealing property and the lubricity during the compression.

In FIG. 9(A) showing a time point when first compression chamber 15*a* is closed, injection port 43 is not open to first compression chamber 15*a*. In FIGS. 9(B) and 9(C) showing a state after the compression starts, injection port 43 is open to first compression chamber 15*a*.

Similarly, in FIG. 9(C) showing a time point when second compression chamber 15*b* is closed, injection port 43 is not open to second compression chamber 15*b*. In a state of FIG. 9(A) showing a state in which the compression is progressed, injection port 43 is open to second compression chamber 15*b*.

Accordingly, since the injection refrigerant can be compressed without flowing back to suction port 17 while a space of injection port 43 is saved, it is easy to increase the amount of a circulating refrigerant and it is possible to perform a highly efficient injection operation.

In this way, injection port 43 is provided at a position where injection port 43 is sequentially open to first compression chamber 15*a* and second compression chamber 15*b*. Further, injection port 43 is provided to penetrate the end plate of fixed scroll 12 at a position where injection port 43 is open to first compression chamber 15*a* during the compression stroke after the suction refrigerant is introduced and closed as illustrated in FIGS. 9(B) and 9(C) or second compression chamber 15*b* during the compression stroke after the suction refrigerant is introduced and closed as illustrated in the FIG. 9(A).

An opening section in which injection port 43 is open to first compression chamber 15*a* is longer than an opening section in which injection port 43 is open to second compression chamber 15*b*. The amount of the refrigerant to be injected from injection port 43 to first compression chamber 15*a* is more than the amount of the refrigerant to be injected from injection port 43 to second compression chamber 15*b*. Here, as illustrated in FIG. 7, even in a state in which the injection is not performed, an increase rate of the internal pressure of first compression chamber 15*a* is less than an increase rate of the internal pressure of second compression chamber 15*b*. Therefore, the increase rate of the internal pressure of first compression chamber 15*a* increases in order to realize a high injection rate. Even when the same amount of the injected refrigerant is injected to first compression chamber 15*a* having a large suction volume and second compression chamber 15*b* having a small suction volume, the increase rate of the internal pressure of first compression chamber 15*a* is smaller.

Figure 10:
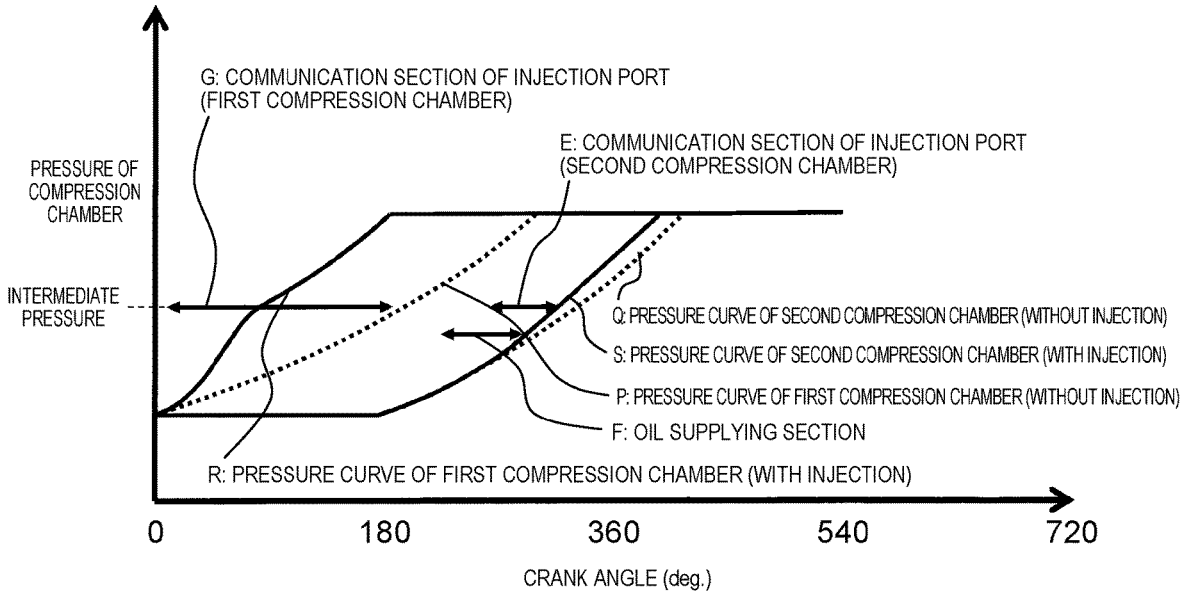
FIG. 10 is a diagram showing a relationship between an internal pressure, an opening section, and an oil supplying section of the compression chamber of the asymmetrical scroll compressor according to the first embodiment of the present invention.

FIG. 10 is a diagram showing a relationship between an internal pressure, an opening section, and an oil supplying section of the compression chamber of the asymmetrical scroll compressor according to the present embodiment.

Pressure curve P showing a pressure change of first compression chamber 15*a* with respect to a crank angle that is a rotation angle of a crank without injection and pressure curve Q showing a pressure change of second compression chamber 15*b* without injection are illustrated in FIG. 10. Further, pressure curve R showing a pressure change of first compression chamber 15*a* with respect to the crank angle that is the rotation angle of the crank with the injection and pressure curve S showing a pressure change of second compression chamber 15*b* with injection are illustrated in FIG. 10.

As illustrated in FIG. 10, communication section E of injection port 43 to second compression chamber 15*b* and at least a partial section of oil supplying section F from back-pressure chamber 29 to second compression chamber 15*b* overlap with each other. An overlapping section where oil supplying section F overlaps with communication section E is a partial section of the second half of oil supplying section F, and injection port 43 is open in the second half of oil supplying section F so that communication section E starts.

In FIG. 9, From FIG. 9(C) to FIG. 9(D), oil supplying section F to second compression chamber 15*b* starts. Thereafter, from FIG. 9(D) to FIG. 9(A), an overlapping section exists while injection port 43 is open to and communicates with second compression chamber 15*b*. In the present embodiment, oil supplying section F is the same as an opening of third opening end 56*a* to recess 12*a*. The pressure of back-pressure chamber 29 depends on the internal pressure of compression chamber 15 at an end of oil supplying section F, and the injection refrigerant is sent to compression chamber 15 from a middle of oil supplying section F. Thus, the pressure of back-pressure chamber 29 increases only during the injection operation, and it is possible to suppress destabilization of behavior of orbiting scroll 13. Further, the reason why start of the opening of injection port 43 to second compression chamber 15*b* is not hastened until the first half of oil supplying section F is as follows. That is, when the internal pressure of second compression chamber 15*b* increases due to the injection refrigerant from an early stage of oil supplying section F, the internal pressure of second compression chamber 15*b* and the pressure of back-pressure chamber 29 become equal to each other before the oil is sufficiently supplied to second compression chamber 15*b* from back-pressure chamber 29. Thus, a possibility that a problem occurs in reliability of compressor 91 that lacks oil supplying increases. Hereinabove, although the oil supplying and the injection to second compression chamber 15*b* have been described, the same operation is performed even for first compression chamber 15*a*.

At least a part of the oil supplying section to compression chamber 15 is configured to overlap with an opening section of injection port 43. Thus, application of the pressure from rear surface 13*e* to orbiting scroll 13 increases together with the internal pressure of compression chamber 15 during the oil supplying section as the intermediate pressure of the injection refrigerant increases. Therefore, orbiting scroll 13 is more stably pressed against fixed scroll 12, so that stable operation can be performed while leakage from back-pressure chamber 29 to compression chamber 15 is reduced. Accordingly, the behavior of orbiting scroll 13 can more stably realize optimum performance, and can further improve an injection rate.

In the present embodiment, as illustrated in FIG. 10, a case where communication section G where injection port 43 is open to first compression chamber 15*a* is longer than communication section E where injection port 43 is open to second compression chamber 15*b* is shown. However, with this configuration or instead of this configuration, it is preferable that a pressure difference between the intermediate pressure of injection port 43 and the internal pressure of first compression chamber 15*a* when injection port 43 is open to first compression chamber 15*a* is more than a pressure difference between the intermediate pressure of injection port 43 and the internal pressure of second compression chamber 15*b* when injection port 43 is open to second compression chamber 15*b*. The amount of injection into first compression chamber 15*a* having a large volume and a slow pressure increasing rate can certainly increase, and efficient distribution of the amount of the injection refrigerant can be achieved.

Figure 11:
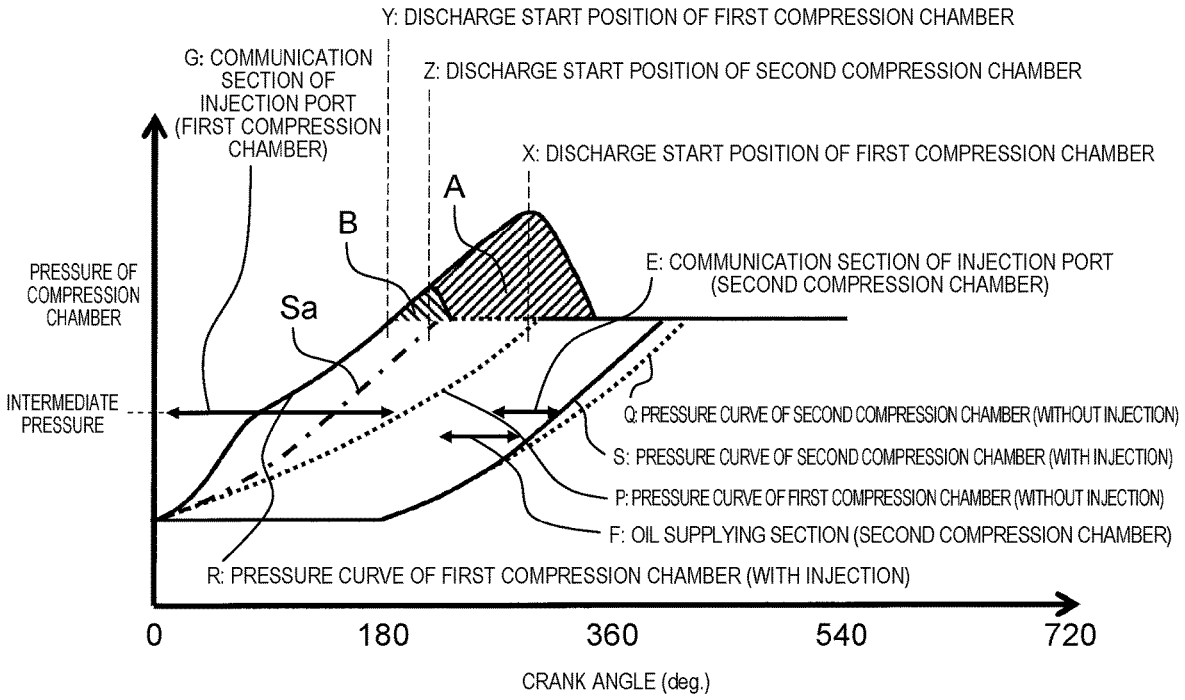
FIG. 11 is a diagram showing a relationship between the internal pressure and the discharge start position of the compression chamber of the asymmetrical scroll compressor according to the first embodiment of the present invention.

FIG. 11 is a diagram showing a relationship between the internal pressure and the discharge start position of the compression chamber of the asymmetrical scroll compressor according to the present embodiment.

Pressure curve P showing the pressure change of first compression chamber 15*a* with respect to the crank angle that is the rotation angle of the crank without injection and pressure curve Q showing the pressure change of second compression chamber 15*b* without injection are shown in FIG. 11. Further, pressure curve R showing the pressure change of first compression chamber 15*a* with respect to the crank angle that is the rotation angle of the crank with injection and pressure curve S showing the pressure change of second compression chamber 15*b* with injection are shown in FIG. 11. Further, pressure curve Sa of which a compression start point is matched with a compression start point of pressure curve R by sliding pressure curve S by 180 degrees is shown.

In FIG. 7, a difference in a compression rate due to a difference in a suction volume when the injection is not performed has been described. It has been described that in a compression chamber according to the related art, second compression chamber 15*b* reaches the discharge pressure within a short compression section from start of the compression. Because of this, in the compressor according to the related art, it is preferable that discharge bypass port 21 is provided at a position where second compression chamber 15*b* is early opened with reference to the start of the compression. However, in the present embodiment, the amount of the injection refrigerant to first compression chamber 15*a* increases. Thus, in particular, the pressure increasing rate of first compression chamber 15*a* is faster than the pressure increasing rate of second compression chamber 15*b* during operation with the high injection rate.

In a case where there is the injection, similar to FIG. 7, pressure curve Sa obtained by sliding pressure curve S of second compression chamber 15*b* such that a compression start point of pressure curve S is matched with the compression start point of pressure curve Sa is shown in FIG. 11.

A discharge start position where pressure curve R of first compression chamber 15*a* with the injection reaches a discharge pressure is earlier than a discharge start position of pressure curve Sa of second compression chamber 15*b* with the injection. That is, an opposite configuration to that of FIG. 7 is required due to effects of the injection refrigerant. In FIG. 11, when discharge bypass port 21 is provided according to a volume ratio of discharge start position X of the first compression chamber without the injection, in first compression chamber 15*a* with the injection, the compression continues after the pressure reaches discharge start position Y, and a compression power corresponding to an area of B and A between discharge start position X and discharge start position Y is additionally required. Thus, even when a discharge start position of discharge bypass port 21 of first compression chamber 15*a* rapidly reaches a position equivalent to a discharge start position (discharge start position Z of pressure curve Sa in which the compression start point is matched in the drawing) of pressure curve S, the compression power corresponding to the area of B is still required, and a power consumption reduction effect resulting from the high injection rate is canceled. Thus, in the present embodiment, discharge bypass port 21 is provided at a position where first compression chamber 15*a* having a large injection amount can perform discharge at an earlier timing than second compression chamber 15*b*.

In this way, in a central portion of the end plate of fixed scroll 12, discharge port 18 through which the refrigerant compressed in compression chamber 15 is discharged is included, and discharge bypass port 21 through which the refrigerant compressed in compression chamber 15 before first compression chamber 15*a* communicates with discharge port 18 is discharged is provided. Further, a volume ratio that is a ratio of the suction volume to the discharge volume of compression chamber 15 in which the refrigerant in compression chamber 15 can be discharged is smaller in first compression chamber 15*a* than in second compression chamber 15*b*. Thus, even in a maximum injection state, an excessive increase in the pressure of first compression chamber 15*a* can be suppressed.

Second Embodiment

Figure 12:
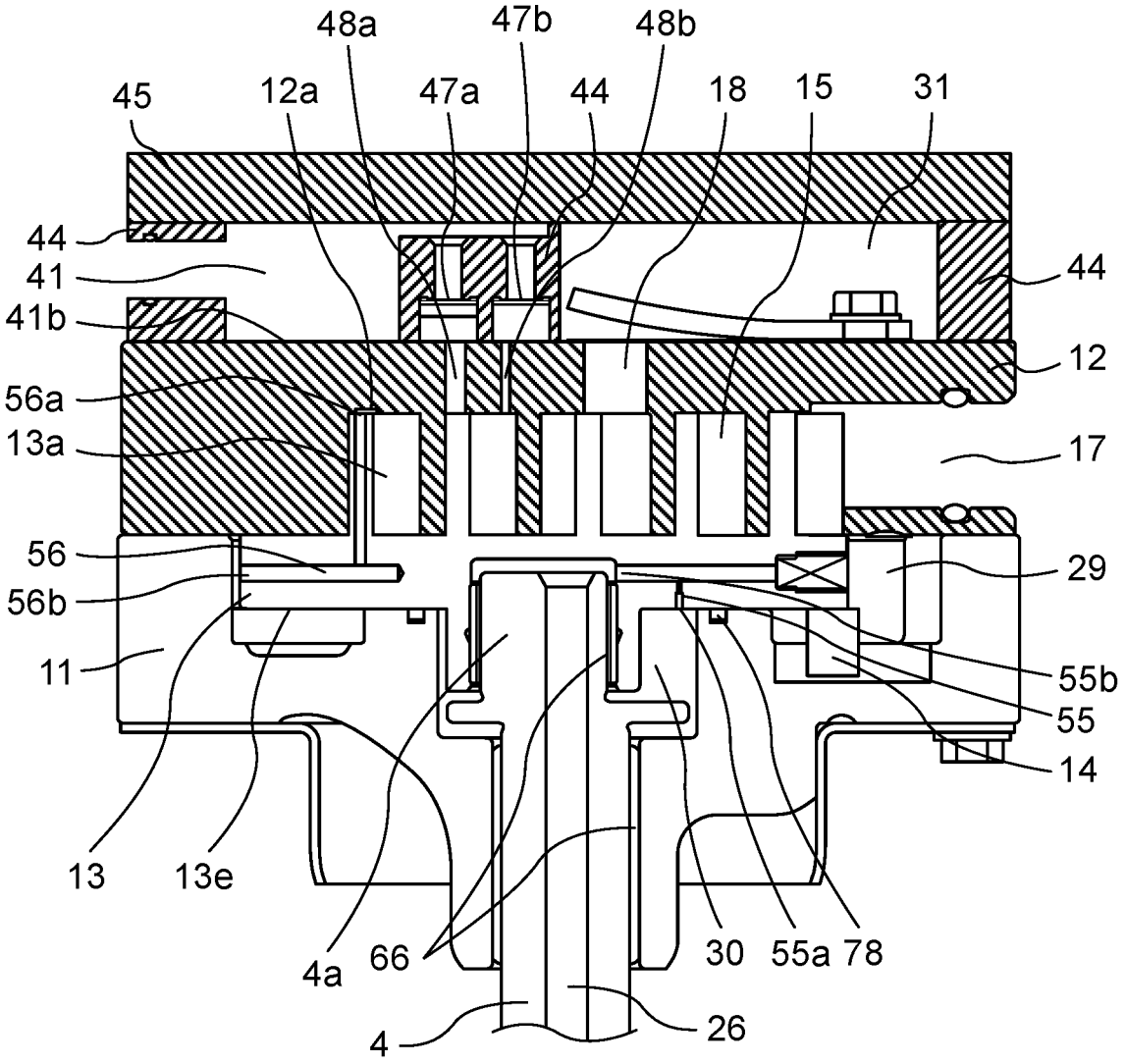
FIG. 12 is a longitudinal sectional view showing a main part of an asymmetrical scroll compressor according to a second embodiment of the present invention.

FIG. 12 is a longitudinal sectional view showing a main part of an asymmetrical scroll compressor according to a second embodiment of the present invention.

In the present embodiment, first injection port 48*a* that is open only to first compression chamber 15*a* and second injection port 48*b* that is open only to second compression chamber 15*b* are included. First injection port 48*a* is provided with first check valve 47*a*, and second injection port 48*b* is provided with second check valve 47*b*. Since the other configuration is the same as the configuration of the first embodiment, the same reference numerals are designated, and description thereof will be omitted.

In the present embodiment, as the port diameter of first injection port 48*a* is more than the port diameter of second injection port 48*b*, the amount of the refrigerant injected from first injection port 48*a* into first compression chamber 15*a* is more than the amount of the refrigerant injected from second injection port 48*b* into second compression chamber 15*b*.

In this way, as first injection port 48*a* that is open only to first compression chamber 15*a* and second injection port 48*b* that is open only to second compression chamber 15*b* are provided, the amounts of the injection to first compression chamber 15*a* and second compression chamber 15*b* can be individually adjusted. In addition, the refrigerant can be always injected into first compression chamber 15*a* and second compression chamber 15*b* or can be simultaneously injected into first compression chamber 15*a* and second compression chamber 15*b*. Thus, it is effective to achieve a high injection rate under a condition in which a pressure difference in the refrigeration cycle is large. Further, since the degree of freedom in setting the oil supplying section from back-pressure chamber 29 increases, a pressure adjusting function can be effectively utilized in back-pressure chamber 29, and addition of the pressure from rear surface 13*e* of orbiting scroll 13 can be stably controlled.

In the present embodiment, a case where first injection port 48*a* has a larger port diameter than second injection port 48*b* has been shown. With this configuration or instead of this configuration, the communication section in which first injection port 48*a* is open to first compression chamber 15*a* may be longer than the opening section in which second injection port 48*b* is open to second compression chamber 15*b*. Further, a pressure difference between the intermediate pressure in first injection port 48*a* and the internal pressure of first compression chamber 15*a* when first injection port 48*a* is open to first compression chamber 15*a* may be more than a pressure difference between the intermediate pressure in second injection port 48*b* and the internal pressure of second compression chamber 15*b* when second injection port 48*b* is open to second compression chamber 15*b*.

Further, in the present embodiment, first injection port 48*a* and second injection port 48*b* are respectively open only to first compression chamber 15*a* and second compression chamber 15*b* have been described. However, the present invention is not limited to this configuration. Using an injection port that is open to both first compression chamber 15*a* and second compression chamber 15*b* or a combination of first injection port 48*a* and second injection port 48*b* are respectively open only to first compression chamber 15*a* and second compression chamber 15*b*, the amount of the injection into first compression chamber 15*a* may be more than the amount of the injection into second compression chamber 15*b*.

When R32 or carbon dioxide, in which the temperature of a discharged refrigerant is easy to be high, is used as a refrigerant that is a working fluid, an effect of suppressing an increase in the temperature of the discharged refrigerant is exhibited. Thus, deterioration of a resin material such as an insulating material of motor unit 3 can be suppressed, and a compressor that is reliable for a long time can be provided.

Meanwhile, when a refrigerant having a double bond between carbons or a refrigerant including the refrigerant and having a global warming potential (GWP; a global warming factor) of 500 or less is used, a refrigerant decomposition reaction is likely to occur at high temperatures. Thus, an effect for long-term stability of the refrigerant is exhibited according to the effect of suppressing the increase in the temperature of the discharge refrigerant.

In the asymmetrical scroll compressor according to the first disclosure, at least one injection port through which an intermediate-pressure refrigerant is injected into the first compression chamber and the second compression chamber, the at least one injection port penetrating the end plate of the fixed scroll at a position where the injection port is open to the first compression chamber or the second compression chamber during the compression stroke after the suction refrigerant is introduced and closed. Further, the amount of the refrigerant injected from the injection port into the first compression chamber is more than the amount of the refrigerant injected from the injection port into the second compression chamber.

With this configuration, as a large amount of the refrigerant is injected into the first compression chamber having a large volume, an injection rate can increase, an injection cycle effect can be maximized, efficiency can be improved more than ever, and a capacity expansion effect can be obtained.

According to a second disclosure, in the asymmetrical scroll compressor according to the first disclosure, the injection port is provided with a check valve which allows flow of the refrigerant to the compression chamber and suppresses flow of the refrigerant from the compression chamber.

With this configuration, as the check valve and the compression chamber are provided close to each other, even when the internal pressure of the compression chamber increases to the intermediate pressure or more in a section in which the injection port is open to the compression chamber, the compression of the refrigerant in a space that is ineffective for compression, such as the injection pipe can be minimized, and the injection rate can be increased to a condition in which theoretical performance of an injection cycle can be exhibited to maximum.

According to a third disclosure, in the asymmetrical scroll compressor according to the first disclosure or the second disclosure, the oil reservoir in which the oil is stored is defined in the sealed container including the fixed scroll and the orbiting scroll therein, and the high-pressure area and the back-pressure chamber are defined on the rear surface of the orbiting scroll. Further, the oil supplying passage through which the oil is supplied from the oil reservoir to the compression chamber passes through the back-pressure chamber, and the oil supplying passage through which the back-pressure chamber communicates with the first compression chamber and the second compression chamber is provided at a position open to the first compression chamber or the second compression chamber during the compression stroke after the suction refrigerant is introduced and closed. Further, at least a partial section of the oil supplying section in which the oil supplying passage communicates with the first compression chamber or the second compression chamber overlaps with the opening section in which the injection port is open to the first compression chamber or the second compression chamber.

When the intermediate-pressure refrigerant is injected into the compression chamber, the internal pressure of the compression chamber more quickly increases than in a case where the intermediate-pressure refrigerant is not injected. Thus, a force for separating the orbiting scroll from the fixed scroll increases more than in the related art. According to a configuration of the third disclosure, a force for pressing the orbiting scroll against the fixed scroll interlocks with the internal pressure of the compression chamber with which the oil supplying passage communicates. Therefore, as the intermediate-pressure refrigerant is injected into the compression chamber, the force for pressing the orbiting scroll against the fixed scroll increases, and stable operation can be performed while the orbiting scroll is not separated from the fixed scroll.

According to a fourth disclosure, in the asymmetrical scroll compressor according to the third disclosure, the overlapping section where the oil supplying section overlaps with the opening section is a part of the latter half of the oil supplying section.

With this configuration, since the pressure of the back-pressure chamber interlocks with the internal pressure of the compression chamber in the second half of the overlapping section, the pressure of the back-pressure chamber can be set according to the internal pressure of the compression chamber in a state in which the injection is completed or in a state in which the injection is further performed. Accordingly, under a condition in which a separation force of the orbiting scroll by the injection is large, the pressure of the back-pressure chamber is high and stable orbiting movement is possible. On the other hand, under a condition in which the injection amount is small, the pressure of the back-pressure chamber is low, and an excessive pressing force against the fixed scroll can be prevented.

According to a fifth disclosure, in the asymmetrical scroll compressor according to any one of the first disclosure to the fourth disclosure, at least one injection port is provided at a position where the injection port is sequentially open to the first compression chamber and the second compression chamber.

With this configuration, since the injection port can be shared when the injection into both the first and second compression chambers is performed, miniaturization and a reduction in the number of components can be achieved, and the injection rate increases so that the injection cycle effect can be maximized. Further, in general, in the asymmetrical scroll compressor, compression start timings of the first compression chamber and the second compression chamber are different from each other by 180 degrees. Thus, immediately after start of the compression from one injection port even to any compression chamber, the injection port may be provided at a position where the injection is performed, and is suitable for realizing a high injection rate.

According to a sixth disclosure, in the asymmetrical scroll compressor according to the fifth disclosure, the opening section in which the injection port is open to the first compression chamber is longer than the opening section in which the injection port is open to the second compression chamber. A pressure difference between the intermediate pressure of the injection port and the internal pressure of the first compression chamber when the injection port is open to the first compression chamber is more than a pressure difference between the intermediate pressure of the injection port and the internal pressure of the second compression chamber when the injection port is open to the second compression chamber.

With this configuration, the amount of the injection into the first compression chamber having a large volume and a slow pressure increasing rate can certainly increase, and efficient distribution of the amount of the injected refrigerant can be achieved.

According to a seventh disclosure, in the asymmetrical scroll compressor according to any one of the first disclosure to the fourth disclosure, the injection port includes the first injection port that is open only to the first compression chamber and the second injection port that is open only to the second compression chamber. Further, the first injection port has a larger port diameter than the second injection port. Further, the opening section in which the first injection port is open to the first compression chamber is longer than the opening section in which the second injection port is open to the second compression chamber. Otherwise, the pressure difference between the intermediate pressure in the first injection port and the internal pressure of the first compression chamber when the first injection port is open to the first compression chamber is more than the pressure difference between the intermediate pressure of the second injection port and the internal pressure of the second compression chamber when the second injection port is open to the second compression chamber.

With this configuration, the amount of injection into the first compression chamber having a large volume and a slow pressure increase rate can be certainly increased, and efficient distribution of the amount of the injected refrigerant can be achieved.

According to an eighth disclosure, in the asymmetrical scroll compressor according to any one of the first disclosure to the seventh disclosure, a discharge port through which the refrigerant compressed in the compression chamber is discharged is provided at a central portion of the end plate of the fixed scroll. Further, a discharge bypass port through which the refrigerant compressed in the compression chamber is discharged before the first compression chamber communicates with the discharge port is provided. A volume ratio, a ratio of the suction volume to the discharge volume of the compression chamber at which the refrigerant in the compression chamber can be discharged, is smaller in the first compression chamber than in the second compression chamber.

In a general scroll compressor, the compression chamber volumes of the refrigerant that can be discharged from the first compression chamber and the second compression chamber are substantially equal to each other, and the compression chamber volumes are equal to the suction volume at the start of the compression. Thus, when the volume ratios of the first compression chamber and the second compression chamber are compared with each other, the volume ratio is also larger in the first compression chamber having a large suction volume. However, as the injection to the first compression chamber is further performed, the internal pressure of the first compression chamber rather than that of the second compression chamber reaches the discharge pressure in a shorter compression section. Even when the internal pressure of the compression chamber reaches the discharge pressure, when the dischargeable port and the compression chamber do not communicate with each other, excessive compression is generated. Thus, additional compression power is required, and the force of separating the orbiting scroll from the fixed scroll is generated, which causes deterioration of compression movement.

With this configuration according to an eighth disclosure, as the volume ratio is smaller in the first compression chamber than in the second compression chamber, even in a maximum injection state, an excessive increase in the pressure of the first compression chamber can be suppressed.

INDUSTRIAL APPLICABILITY

An asymmetrical scroll compressor according to the present invention is useful for a refrigeration cycle apparatus, such as a hot water heater, an air conditioner, a water heater, and a refrigerator, in which an evaporator is used in a low temperature environment.

REFERENCE MARKS IN THE DRAWINGS

1 SEALED CONTAINER
2 COMPRESSION MECHANISM
3 MOTOR UNIT
4 SHAFT
4*a* ECCENTRIC SHAFT PORTION
6 OIL
11 MAIN BEARING MEMBER
12 FIXED SCROLL

12*a* RECESS
13 ORBITING SCROLL
13*c* WRAP TIP END
13*e* REAR SURFACE
14 ROTATION RESTRAINING MECHANISM
15 COMPRESSION CHAMBER
15*a* FIRST COMPRESSION CHAMBER
15*b* SECOND COMPRESSION CHAMBER
16 SUCTION PIPE
17 SUCTION PORT
18 DISCHARGE PORT
19 DISCHARGE REED VALVE
20 OIL RESERVOIR
21, 21*a*, 21*b* DISCHARGE BYPASS PORT
25 PUMP
26 OIL SUPPLYING HOLE
29 BACK-PRESSURE CHAMBER
30 HIGH-PRESSURE AREA
31 DISCHARGE CHAMBER
41 INTERMEDIATE-PRESSURE CHAMBER
41*a* INTERMEDIATE-PRESSURE CHAMBER INLET
41*b* LIQUID RESERVOIR PORTION
42 CHECK VALVE
42*a* REED VALVE
42*b* VALVE STOP
43 INJECTION PORT
43*a* INJECTION PORT INLET
44 INTERMEDIATE-PRESSURE PLATE
45 INTERMEDIATE-PRESSURE COVER
46 FIXING MEMBER
47*a* FIRST CHECK VALVE
47*b* SECOND CHECK VALVE
48 INJECTION PORT
48*a* FIRST INJECTION PORT
48*b* SECOND INJECTION PORT
55 CONNECTION PASSAGE
55*a* FIRST OPENING END
55*b* SECOND OPENING END
56 SUPPLY PASSAGE
56*a* THIRD OPENING END
56*b* FOURTH OPENING END
66 BEARING PORTION
78 SEALING MEMBER
01 COMPRESSOR
92 CONDENSER
93 EVAPORATOR
94*a*, 94*b* EXPANSION VALVES
95 INJECTION PIPE
96 GAS-LIQUID SEPARATOR

The invention claimed is:

1. An asymmetrical scroll compressor comprising:

a fixed scroll including a first spiral wrap standing up from an end plate of the fixed scroll; and an orbiting scroll including a second spiral wrap standing up from an end plate of the orbiting scroll;

wherein the first spiral wrap of the fixed scroll is engaged with the second spiral wrap of the orbiting scroll to define a compression chamber between the fixed scroll and the orbiting scroll, the compression chamber includes a first compression chamber on an outer wrap wall side of the orbiting scroll; and a second compression chamber on an inner wrap wall side of the orbiting scroll, a suction volume of the first compression chamber is more than a suction volume of the second compression chamber, the asymmetrical scroll compressor further comprises at least one injection port through which an intermediate-pressure refrigerant is injected into the first compression chamber and the second compression chamber, the at least one injection port penetrating the end plate of the fixed scroll at a position where the injection port is open to the first compression chamber or the second compression chamber during a compression stroke after a suction refrigerant is introduced and closed, and an amount of the refrigerant injected from the injection port to the first compression chamber is more than an amount of the refrigerant injected from the injection port to the second compression chamber, wherein an oil reservoir in which oil is stored is defined in a sealed container including the fixed scroll and the orbiting scroll, a high-pressure area and a back-pressure chamber are defined on a rear surface of the orbiting scroll, an oil supplying passage through which the oil is supplied from the oil reservoir to the compression chamber passes through the back-pressure chamber, the oil supplying passage through which the back-pressure chamber communicates with the first compression chamber and the second compression chamber is provided at the position where the injection port is open to the first compression chamber and the second compression chamber during the compression stroke after the suction refrigerant is introduced and closed, and at least a partial section of an oil supplying section in which the oil supplying passage communicates with the first compression chamber or the second compression chamber overlaps with an opening section in which the injection port is open to the first compression chamber or the second compression chamber.

2. The asymmetrical scroll compressor of claim 1, wherein a check valve that allows flow of the refrigerant to the compression chamber and suppresses flow of the refrigerant from the compression chamber is provided in the injection port.

3. The asymmetrical scroll compressor of claim 2, wherein an overlapping section where the oil supplying section overlaps with the opening section is defined as a partial section of a latter half of the oil supplying section.

4. The asymmetrical scroll compressor of claim 1, wherein an overlapping section where the oil supplying section overlaps with the opening section is defined as a partial section of a latter half of the oil supplying section.

5. The asymmetrical scroll compressor of claim 1, wherein at least one injection port is provided at a position where the injection port is sequentially open to the first compression chamber and the second compression chamber.

6. The asymmetrical scroll compressor of claim 5, wherein an opening section in which the injection port is open to the first compression chamber is longer than an opening section in which the injection port is open to the second compression chamber, or a pressure difference between an intermediate pressure in the injection port and an internal pressure of the first compression chamber when the injection port is open to the first compression chamber is more than a pressure difference between an intermediate pressure in the injection port and an internal pressure of the second compression chamber when the injection port is open to the second compression chamber.

7. The asymmetrical scroll compressor of claim 1, wherein as the injection port, a first injection port that is open only to the first compression chamber and a second injection port that is open only to the second compression chamber are provided, the first injection port has a larger port diameter than the second injection port, an opening section in which the first injection port is open to the first compression chamber is longer than an opening section in which the second injection port is open to the second compression chamber, or a pressure difference between an intermediate pressure in the first injection port and an internal pressure of the first compression chamber when the first injection port is open to the first compression chamber is more than a pressure difference between an intermediate pressure in the second injection port and an internal pressure of the second compression chamber when the second injection port is open to the second compression chamber.

8. The asymmetrical scroll compressor of claim 7, wherein a discharge port through which the refrigerant compressed in the compression chamber is discharged is provided at a central portion of the end plate of the fixed scroll, a discharge bypass port through which the refrigerant compressed in the compression chamber is discharged before the first compression chamber communicates with the discharge port is provided, and a volume ratio, which is a ratio of the suction volume to a discharge volume of the compression chamber at which the refrigerant in the compression chamber is able to be discharged, is smaller in the first compression chamber than in the second compression chamber.

9. The asymmetrical scroll compressor of claim 1, wherein a discharge port through which the refrigerant compressed in the compression chamber is discharged is provided at a central portion of the end plate of the fixed scroll, a discharge bypass port through which the refrigerant compressed in the compression chamber is discharged before the first compression chamber communicates with the discharge port is provided, and a volume ratio, which is a ratio of the suction volume to a discharge volume of the compression chamber at which the refrigerant in the compression chamber is able to be discharged, is smaller in the first compression chamber than in the second compression chamber.

* * * * *